US005746348A

United States Patent [19]

Bloom

[11] Patent Number: 5,746,348

[45] Date of Patent: May 5, 1998

[54] HAIR TREATMENT TIMER RECEPTACLE WITH DETACHABLE TIMER

[76] Inventor: Robert Bloom, 425 Ascot La., Streamwood, Ill. 60101

[21] Appl. No.: 679,967

[22] Filed: Jul. 15, 1996

[51] Int. Cl.[6] ..... B63D 5/32

[52] U.S. Cl. ..... 222/39; 222/184; 222/568

[58] Field of Search ..... 222/39, 184, 325, 222/460, 568

[56] References Cited

U.S. PATENT DOCUMENTS

| | | | |
|---|---|---|---|
| 4,361,408 | 11/1982 | Wirtschafter | 368/10 |
| 4,419,016 | 12/1983 | Zoltan | 368/10 |
| 4,872,594 | 10/1989 | Bloom | 222/173 |
| 4,939,705 | 7/1990 | Hamilton et al. | 368/10 |
| 4,991,755 | 2/1991 | Grusmark | 222/638 |
| 5,062,549 | 11/1991 | Smith et al. | 222/184 X |
| 5,239,491 | 8/1993 | Mucciacciaro | 264/569 |
| 5,313,439 | 5/1994 | Albeck | 368/10 |

*Primary Examiner*—Gregory L. Huson
*Attorney, Agent, or Firm*—James T. Harris

[57] ABSTRACT

A hair treatment applicator timer receptacle including in one embodiment, in axially aligned relation, an applicator spout including a base portion and an applicator tip portion, an elongated liquid receptacle in bottle form, and a housing having a timer mechanism therein. The means for attachment of the receptacle to the housing is adapted for easy attachment and detachment of the receptacle from the base. The timer includes a digital LCD display audio alarm to indicate the expiration of a pre-set time period. The bottle-type liquid receptacle is a collapsible plastic container. The plastic container defines an open mouth which is removably closed by the applicator spout. An annular reservoir surrounds the base of the applicator tip portion for capturing excess hair coloring mixture which inadvertently escapes from the applicator tip portion. In a second embodiment, the invention includes a bowl-type liquid receptacle which is also provided to be easily detachable from the housing having the integral timer mechanism.

10 Claims, 3 Drawing Sheets

FIG. 5
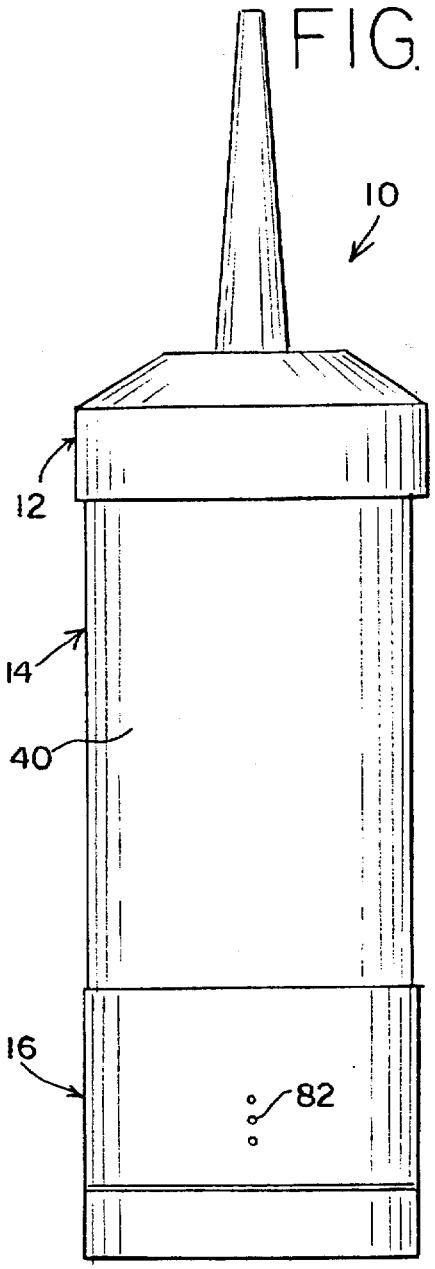
FIG. 6
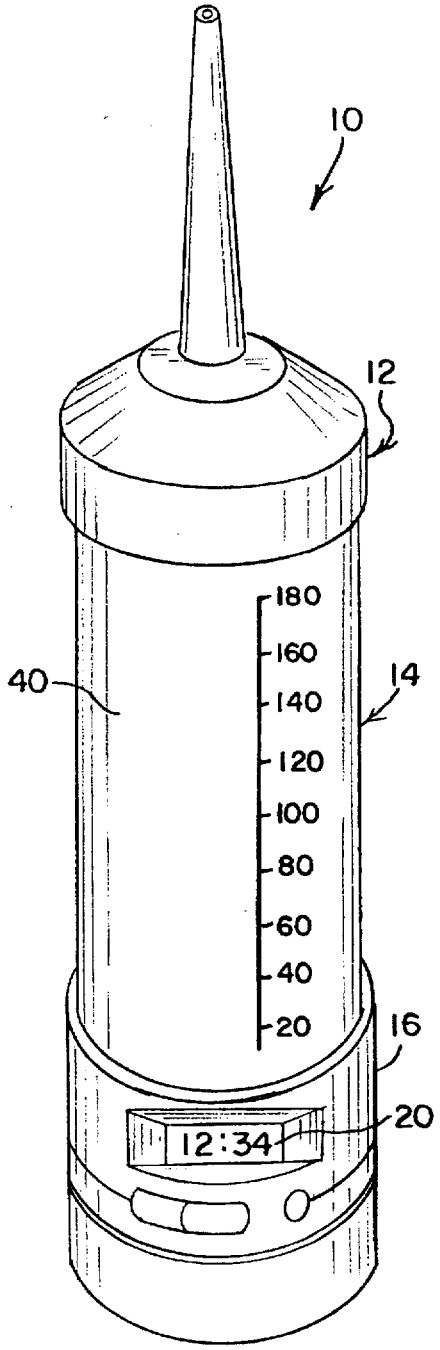
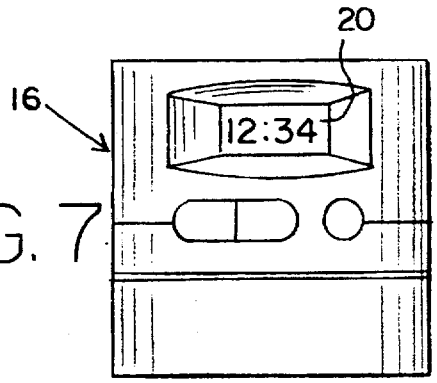
FIG. 7

HAIR TREATMENT TIMER RECEPTACLE WITH DETACHABLE TIMER

BACKGROUND OF THE INVENTION

I. Field of the Invention

This invention relates to liquid receptacles, and, more particularly, to an improved hair treatment applicator receptacle having a detachable timer mechanism.

II. Description of the Prior Art

The prior art includes U.S. Pat. No. 4,872,594, which is owned by a common inventor/owner. This discloses a hair coloring applicator bottle having an attached mechanical timer mechanism. The timer mechanism is mounted such that the hairdresser can quickly assess the amount of time remaining for a particular hair coloring process or procedure. The U.S. Pat. No. 4,872,594 includes in axially aligned relationship, an applicator spout, an elongated liquid bottle-type receptacle, an integral mechanical housing. Time period indicia are provided on either the liquid receptacle or the base. A time pointer is arranged in combination with the time period indicia. The liquid receptacle can be rotated relative to the base to selectively position the time period indicia relative to the timer pointer indicia to selectively set the timer mechanism. This invention is an improvement of the U.S. Pat. No. 4,872,594 in that the timer mechanism is integral to a housing which has means for easy attachment to and detachment from a liquid receptacle. Also, the timer mechanism includes an easy to read, cost efficient, visual digital timer and audio alarm for indicating to the hairdresser the appropriate time to remove any hair treatment from one's hair.

SUMMARY OF THE INVENTION

U.S. Pat. No. 4,872,594 is incorporated by reference. The further improved hair coloring applicator receptacle is illustrated and described continues to prevent the confusion of trying to identify which applicator bottle and timer belong together when using separate applicator bottles and timers in performing hair care operations. This improved hair coloring applicator receptacle allows one to detach the applicator bottle or a bowl from the timer for easy cleansing and washing of the applicator bottle or bowl without possible damage to the timer mechanism during washing of the applicator receptacle, and further has an advantage of providing for an easy to read digital display timer unit for presetting a desired time period and an alarm unit to signal the conclusion of the preset interval time period. The attachment/detachment feature also enables the adaptation of the timer to use on multiple bottles, multiple bowls or a combination of bottles and bowls. The use of economical disposable bottles with retaining of the base would also be enabled.

More specifically, in a preferred embodiment, the hair coloring applicator receptacle has a base which includes an integral digital timer and alarm connected thereto. The digital timer mechanism is mounted such that the hairdresser can quickly assess the amount of time remaining for that particular hair coloring process or procedure. The bottle includes, preferably in an axially aligned relationship, an applicator spout, an elongated liquid receptacle, and a base having an integral digital timer and audio alarm. The base which includes the digital timer, snap fits onto the bottle and therefore is also easy detachable from the applicator bottle.

The timer housing of the present invention is detachably secured to the container holder. The top of the base is recessed to receive, for example, the bottle. The recess has a ridge extending around the inside perimeter of the recess. The bottom of the plastic container has a corresponding recessed edge for fitting within the inside perimeter of the recessed portion of the housing. The recessed edge of the plastic container also has a groove extending around its perimeter. The ridge of the base snappingly fits into the groove of the plastic container to provide for easy attachment and detachment of the base from the container. This detachment allows for safe cleaning of the plastic container without possibility of damaging the timer mechanism and the other advantages in economy and flexibility of use described herein.

In one form of the invention, the base is combined with a liquid bottle receptacle which includes an elongated and collapsible plastic container having an open mouth portion defining a discharge end of the receptacle. The liquid receptacle further includes a container holder arranged at the end of the plastic container opposite the open mouth. To facilitate a proper mixture of ingredients within the container, the container is preferably translucent and has liquid volume indicia thereon.

The applicator spout is removably secured to the discharge end of the liquid receptacle. In this regard, the applicator spout has an internal thread which is screwably engaged with an external thread provided on the mouth portion of the container. The applicator spout includes a base portion and a frusto-conically shaped applicator tip portion of the spout. The applicator tip portion defines a fluid passage the size of which changes along its axial length. A concave recessed area is provided at the lower end of the applicator tip portion. This recessed area acts as a reservoir for any excess hair coloring liquid that may flow along the outside of the applicator tip portion.

The design of the applicator spout facilitates the hair coloring application of the hairdresser. Because the size of the fluid passage changes along the axial length of the applicator spout, the outlet opening of the applicator spout can be relatively small or enlarged depending at what height and angle the applicator tip portion is cut through from the base portion of the applicator spout.

All hair coloring mixtures when oxidized will "brown out", i.e. look the same. To avoid confusion of which applicator bottle contains which hair coloring mixture, it is desirable to manufacture the applicator bottle in different colors to simplify identification.

With the timer housing of the present invention connected to the applicator bottle, the problem of disassociation of these two elements has been eliminated. Moreover, the timer housing of the present invention permits the operator to quickly assess the amount of time remaining for a particular hair coloring procedure or process thereby facilitating time management for a professional hair dresser.

In an alternate embodiment, the timer housing may be used in conjunction with a detachable bowl for holding hair coloring liquid. Many times hairdressers use bowls to hold the hair coloring liquid and utilize brushes to apply the hair coloring liquid from the bowl to the hair as opposed to applying the hair coloring liquid directly to the hair from a bottle. The adaptability of the base of the invention to these different bottle or bowl receptacles is an advantage to the invention.

Other features and advantages of the present invention will become readily apparent from the following detailed description, appended drawings, and accompanying claims.

DETAILED DESCRIPTION OF THE DRAWINGS

FIG. 5 is a rear plan view of the invention;

Figure 8:
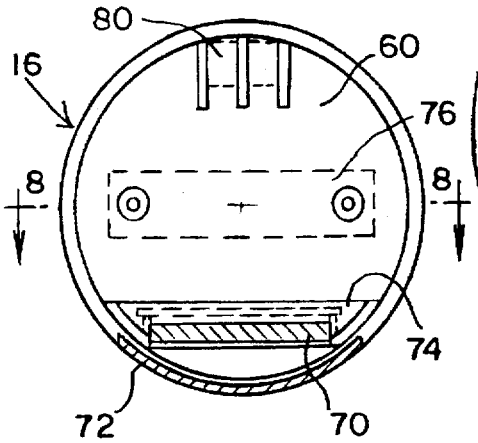
Figure 11:
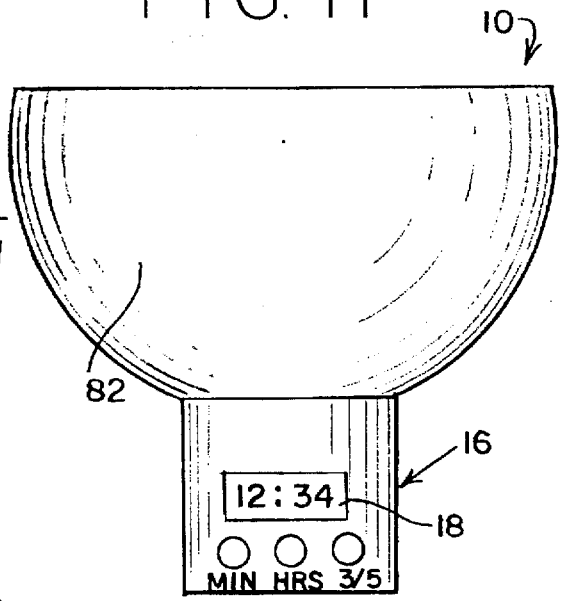
Figure 9:
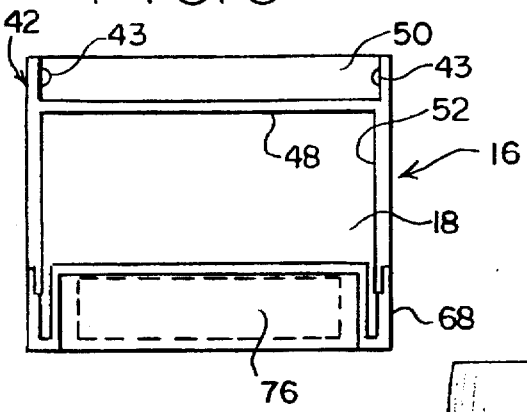
Figure 12:
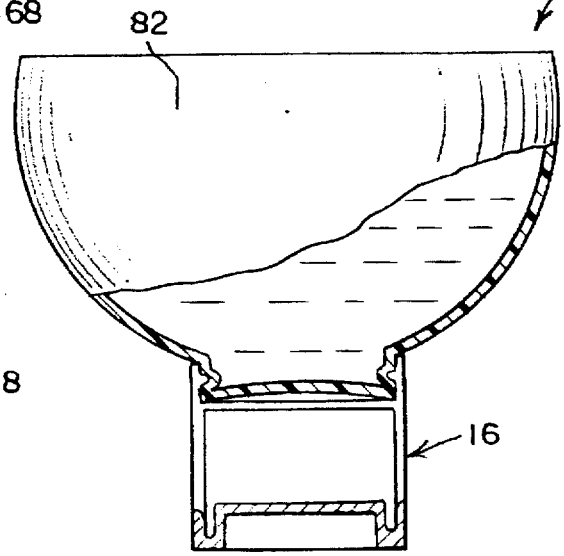
Figure 10:
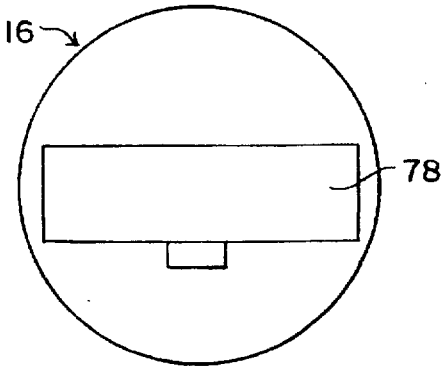

FIG. 6 a perspective view of the hair coloring applicator bottle;

FIG. 7 is front plan view of the base showing the digital timer;

FIG. 8 is a top plan view of the base;

FIG. 9 is a sectional view taken along line 8—8 of FIG. 8;

FIG. 10 is a bottom plan view of the base showing the battery door;

FIG. 11 is a front elevational view of a hair coloring receptacle including a bowl-type liquid container and constructed in accordance with the present invention; and FIG. 12 is a partially cut away sectional view of the hair coloring applicator receptacle including a bowl-type liquid container.

DETAILED DESCRIPTION OF THE PRESENT INVENTION

While the present invention is susceptible of embodiments in various forms, there is shown in the drawings and will hereafter be described, presently preferred embodiments of the invention with the understanding that the present disclosure is to be considered as an exemplification of the invention, and is not intended to limit the invention to the specific embodiments illustrated.

Figure 1:
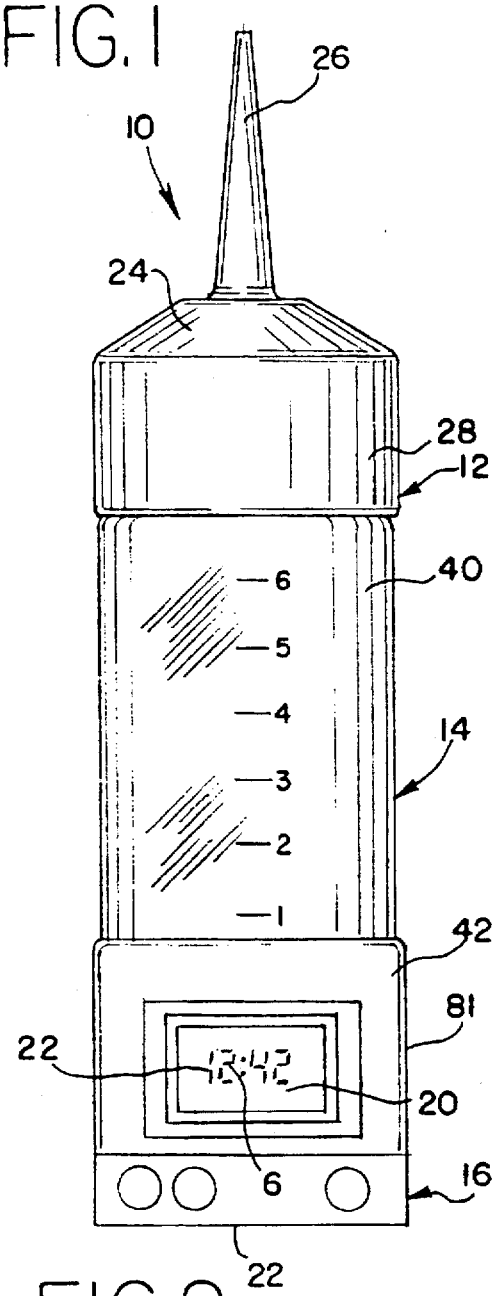
FIG. 1 is a front elevational view of a hair coloring applicator receptacle base in accordance with the principles of the present invention.
Figure 3:
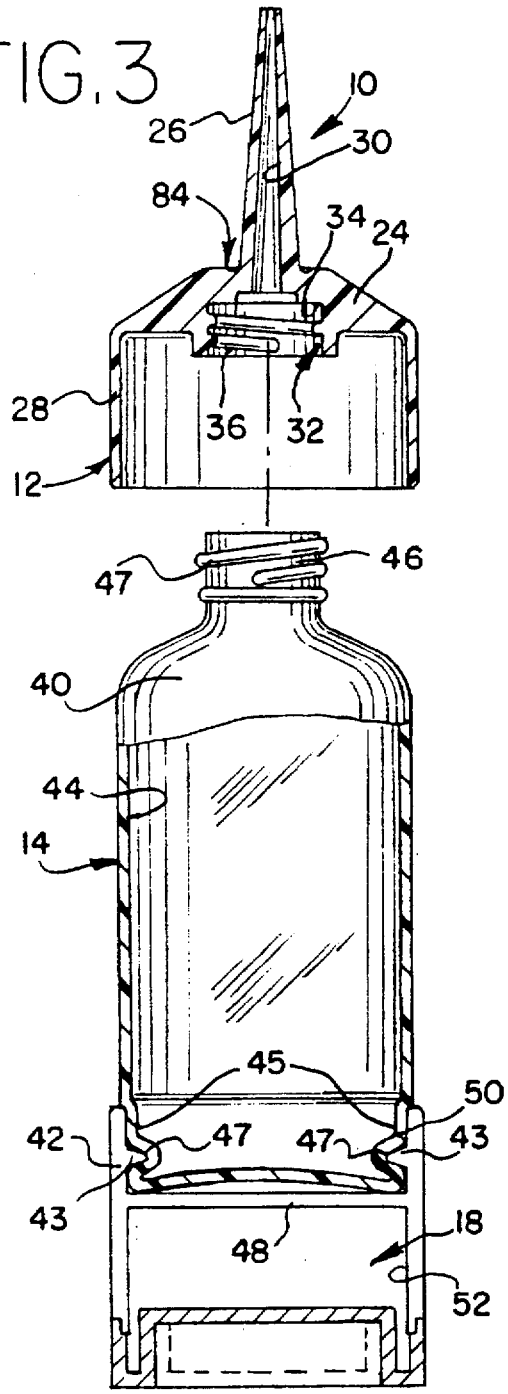
FIG. 3 is a sectional view taken along line 3—3 of FIG. 2.
Figure 2:
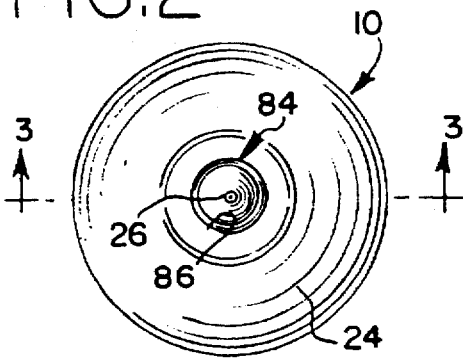
FIG. 2 is a top plan view of the hair coloring applicator receptacle illustrated in FIG. 1.

Referring now to the drawings wherein like reference numbers indicate like parts throughout the several views, there is illustrated a refillable hair coloring applicator bottle 10. In its presently preferred form, bottle 10 includes, in axial aligned order, an applicator spout 12, a liquid receptacle 14, and a detachable base 16 connected to the liquid receptacle 14. Turning to FIG. 3, a digital timer 18 is integral to the detachable housing 16 connected to the liquid receptacle 14. Returning to FIG. 1, a time period display 20 is provided on the base 16.

As illustrated, applicator spout 12 is adapted to be removably secured to the liquid receptacle 14 and may be formed of a suitable synthetic resin such as polyethylene or polypropylene. Spout 12 is of a generally circular configuration and includes a base portion 24 and a frusto-conically shaped applicator tip portion 26 axially extending from base portion 24. As presently preferred, base portion 24 includes a depending cylindrical skirt wall 28 adapted to encircle an upper end of the liquid receptacle or container 14.

Spout 12 defines a fluid passage 30 which extends through the base portion and axially along the length of the applicator tip portion 26. As illustrated in FIG. 3, the cross-sectional size of fluid passage 30 changes along its axial length.

Applicator spout 12 may be plated, painted or molded in different colors to simplify identification of a particular bottle.

Spout 12 further defines a circular central recessed portion 32 which is axially with passage 30. Recessed portion 32 defines an annular sealing end wall 34 and an internal thread 36. If desired, a separate sealing member made of a different synthetic resin, etc., may be disposed in the recessed portion instead of forming the annular sealing end wall integral with the applicator spout.

Liquid receptacle 14 is adapted to be removably secured to the housing 16. As illustrated in FIG. 3, liquid receptacle 14 is formed from a collapsible plastic material and defines a liquid receiving chamber or cavity 44. Preferably, the plastic material forming container 14 is translucent and has liquid volume indicia thereon. Receptacle 14 further defines an open mouth or neck portion 46 defining a discharge end. The mouth or neck portion 46 is cylindrical in shape and on its peripheral surface is formed with an external thread 47 which is adapted to cooperate with the internal thread 36 on application spout 12.

The upper portion 42 of the housing 16 is detachably secured to the bottom end of receptacle 14. The base upper portion 42 is preferably formed as a cylindrical member having an annular wall or web 48 provided intermediate its ends. Web 48 effectively divides the upper portion 42 into first and second chambers 50 and 52. Chamber 50 is sized and configured to securely accommodate receptacle 14. The housing upper portion 42 includes a recessed portion having a ridge 43 extending around the inside perimeter of the recess or chamber 50. The bottom or opposite end the of receptacle 14 has a corresponding recessed edge 45 adapted for fitting within chamber 50 of the housing 16. The recessed edge of the receptacle has a groove 47 extending around its perimeter. The ridge 43 of the housing 16 snappingly fits into the groove 47 of the plastic container to provide for easy attachment and detachment of the housing 16 from the container 14.

The digital timer 60 may be of the type sold by Saple Manufactory Ltd. of Kwun Tong, Hong Kong under Model No. SA-1861. In its preferred form, timer 60 includes suitable means 61 for producing a signal, in the form of visually indication and audible sound, upon expiration of a predetermined time period. As seen in FIG. 8, the timer mechanism as mounted within the base 16, includes a liquid crystal display (LCD) 70 and a printed circuit board (PCB) 74 mounted directly adjacent the LCD 70. A "AAA" battery 76 powers the timer 60 and is stored beneath battery door 78 (FIG. 10). A speaker 80 is included for emitting the audible alarm. Apertures 82 are included in the base to help facilitate the hearing of the audible alarm (FIG. 5). The base also includes a transparent lens 72 mounted adjacent the LCD 70 for facilitating the display the visual time.

Figure 4:
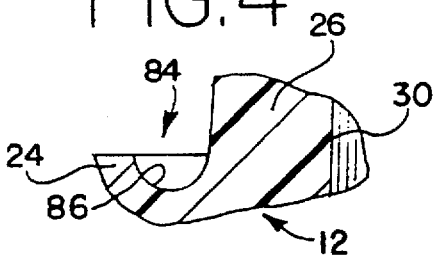
FIG. 4 is an enlarged sectional view detailing a recessed area provided on the base of the present invention.

As best illustrated in FIGS. 3 and 4, the applicator spout 12 further defines an annular reservoir 84 for capturing any excess hair coloring mixture which inadvertently escapes from the applicator tip portion 26. In a preferred form of the invention, reservoir 84 is defined by an annular, shallow, concave recess 86 defined by base portion 24 of spout 12 surrounding the applicator tip 26.

The hair coloring applicator bottle 10 of the present invention is easy to manufacture and is relatively simple in construction. By having the digital timer 18 removably affixed to the receptacle 14, the problem of maintaining integrity between the applicator bottle and timer mechanism has been eliminated. Additionally, the receptacle and base having the integral timer mechanism may be easily separated for easy cleansing of the receptacle without possibility of harm to the timer. The timer 18 may be selectively set as required and provides a signal indicative of the expiration of a predetermined time period set by the operator. The time period display provides quick and ready access to the time remaining in the predetermined set time period in a manner facilitating time management. Having receptacle 14 formed from a translucent plastic with volume indicia facilitates preparation of the hair coloring mixture.

When the applicator spout 12 is secured to the liquid receptacle 14, the sealing end wall 34 removably seals the discharge end of the liquid receptacle. Having the fluid passage 30 vary in size as a function of its length readily lends the spout 12 to different hair coloring applications. That is, the size of the outlet for the fluid passage 30 may be varied depending on whether a root application or a overall hair coloring treatment is to be performed on the customer. Moreover, reservoir 84 at the base of the applicator tip 26 will capture inadvertent excess hair coloring mixture that flows from the applicator tip portion 26.

A second embodiment of the hair coloring applicator timer housing includes a detachable bowl 82 as seen in FIGS. 11 and 12. The detachable bowl has the same interference fit detachable receptacle housing connection as the applicator receptacle with bottle does.

Thus, there has been described numerous modifications and variations which can be effected without departing from the true spirit and scope of the novel concept of the present invention. It will be appreciated that the present disclosure is intended as an exemplification of the invention, and is not intended as an exemplification of the invention, and is not intended to limit the invention to the specific embodiment illustrated. The disclosure is intended to cover by the appended claims all such modifications as fall within the scope of the claims.

What is claimed is:

1. A hair treatment applicator timer receptacle comprising:

liquid receptacle means for receiving and containing hair treatment liquids therein, said receptacle means having a receptacle base portion;

a housing detachably connected to said receptacle base portion for normally maintaining said receptacle means in a vertical orientation, the connection between said receptacle means and said housing including means for easy detachment of the receptacle means from the housing and easy attachment of the receptacle means to the housing;

a timer integral to said housing;

said liquid receptacle means includes an applicator spout removably secured to a discharge end of said receptacle means wherein, said spout includes a spout base portion from which a frusto-conically shaped applicator tip portion axially extends, said applicator tip portion defining an open fluid passage whose size changes along its axial length;

said spout base portion defines a concave recess surrounding a lowermost end of said applicator tip portion said base portion having a web which effectively divides said base into a first chamber and a second chamber, said first chamber being sized and configured to securely accommodate the receptacle.

2. A hair treatment applicator receptacle as in claim 1 wherein said timer is a digital timer which starts at a preset time duration and then counts downward until it reaches zero.

3. A hair treatment applicator timer receptacle as in claim 2 wherein said digital timer includes means for producing an audible signal upon expiration of a predetermined time period set on said digital timer.

4. A hair treatment applicator timer receptacle comprising:

liquid receptacle means for receiving and containing hair treatment liquids therein, said receptacle means having a receptacle base portion;

a housing detachably connected to said receptacle base portion for normally maintaining said receptacle means in a vertical orientation, the connection between said receptacle means and said housing including means for easy detachment of the receptacle means from the housing and easy attachment of the receptacle means to the housing; and a timer integral to said housing;

said means for easy detachment of the receptacle means from the housing and easy attachment of the receptacle means to the housing includes said receptacle base portion having an outside groove extending around the perimeter of said receptacle base portion, said housing having a recessed upper end portion and a corresponding ridge extending around an inside wall of said upper end portion, said groove being adapted to snappingly fit into said corresponding ridge;

said base portion having a web which effectively divides said base into a first chamber and a second chamber, said first chamber being sized and configured to securely accommodate the receptacle.

5. A hair treatment applicator timer receptacle as in claim 1 wherein said liquid receptacle means includes a container having a bowl shape.

6. A hair treatment applicator timer receptacle comprising:

liquid receptacle means for receiving and containing hair treatment liquids therein, said receptacle means having a receptacle base portion, said receptacle base portion having an outside groove extending around the perimeter of said receptacle base portion;

a housing detachably connected to said receptacle base portion for normally maintaining said receptacle means in a vertical orientation, said housing having a recessed upper end portion and a corresponding ridge extending around a inside wall perimeter of said upper end portion, said outside groove being adapted to snappingly fit into said corresponding ridge, thereby, allowing for easy detachment of the receptacle means from the housing and easy attachment of the receptacle means to the housing; and a timer integral to said housing;

said base portion having a web which effectively divides said base into a first chamber and a second chamber, said first chamber being sized and configured to securely accommodate the receptacle.

7. A hair treatment applicator timer receptacle as in claim 6 wherein, said receptacle means includes an elongated plastic container having an open mouth portion defining the discharge end of said receptacle means.

8. A hair treatment applicator receptacle as in claim 6 wherein, said receptacle means includes a plastic container having an open bowl shape.

9. A hair treatment applicator receptacle as in claim 6 wherein, said timer is digital.

10. A hair treatment applicator receptacle as in claim 9 wherein, said digital timer includes means for producing an audible signal upon expiration of a predetermined period set on said digital timer.

* * * * *